US006152561A

United States Patent [19]

Watanabe

[11] Patent Number: 6,152,561

[45] Date of Patent: Nov. 28, 2000

[54] RECORDING APPARATUS

[75] Inventor: Hiroshi Watanabe, Yamato, Japan

[73] Assignee: Canon Kabushiki Kaisha, Tokyo, Japan

[21] Appl. No.: 08/961,217

[22] Filed: Oct. 30, 1997

[30] Foreign Application Priority Data

Oct. 31, 1996 [JP] Japan ..... 8-289436

[51] Int. Cl.[7] ..... B41J 2/01; B65H 3/44

[52] U.S. Cl. ..... 347/104; 271/9.09; 271/9.11; 271/9.13; 399/391

[58] Field of Search ..... 347/101, 104; 399/2, 391, 388, 392; 271/9.13, 9.11, 9.12, 9.09

[56] References Cited

U.S. PATENT DOCUMENTS

| | | | |
|---|---|---|---|
| 3,598,396 | 8/1971 | Andrews et al. | 271/9.11 |
| 4,108,427 | 8/1978 | Komori et al. | 271/9.09 |
| 4,436,406 | 3/1984 | Murasaki et al. | 399/392 |
| 4,733,310 | 3/1988 | Kapp et al. | 358/300 |
| 4,952,981 | 8/1990 | Terashima | 355/309 |
| 4,958,822 | 9/1990 | Rutishauser et al. | 271/9.09 |
| 4,958,823 | 9/1990 | Iwaki et al. | 271/9.11 |
| 5,033,890 | 7/1991 | Niikawa | 271/9.11 X |
| 5,052,670 | 10/1991 | Makiura et al. | 271/9.11 |
| 5,168,316 | 12/1992 | Hino et al. | 399/23 |
| 5,191,382 | 3/1993 | Okamura et al. | 399/107 |
| 5,201,873 | 4/1993 | Kikuchi et al. | 271/9.11 |
| 5,240,238 | 8/1993 | Lee | 271/9.11 |
| 5,321,467 | 6/1994 | Tanaka et al. | 399/2 |
| 5,379,101 | 1/1995 | Takahashi et al. | 399/110 |
| 5,485,990 | 1/1996 | Kato | 271/9.08 |
| 5,666,595 | 9/1997 | Sameshima et al. | 399/391 X |
| 5,758,249 | 5/1998 | Dutton et al. | 399/391 |
| 5,785,308 | 7/1998 | Flores et al. | 271/9.11 |
| 5,870,127 | 2/1999 | Koike et al. | 347/104 |

FOREIGN PATENT DOCUMENTS

| | | |
|---|---|---|
| 0 418 086 | 3/1991 | European Pat. Off. . |
| 0 418 740 | 3/1991 | European Pat. Off. . |
| 8-276625 | 10/1996 | Japan . |
| 2 221 451 | 2/1990 | United Kingdom . |

*Primary Examiner*—William J. Royer
*Attorney, Agent, or Firm*—Fitzpatrick, Cella, Harper & Scinto

[57] ABSTRACT

A recording apparatus has a recording unit for recording, in response to image information, an image on a sheet conveyed through a common convey path, a first sheet support disposed at an upper part of a main body of the recording apparatus to obliquely support stacked sheets, a first automatic supply unit for automatically supplying the sheet supported by the first sheet support, a second sheet support disposed at a lower part of the main body of the recording apparatus to support stacked sheets horizontally, a second automatic supply unit for automatically supplying the sheet supported by the second sheet support, a first sheet supply path for conveying the sheet supplied from the first automatic supply unit sloped downwardly toward the common convey path, a second sheet supply path for surface reversing the sheet supplied from the second automatic supply unit and conveying the sheet toward the common convey path, and a third sheet supply path disposed between the first and second sheet supply paths.

12 Claims, 5 Drawing Sheets

RECORDING APPARATUS

BACKGROUND OF THE INVENTION

1. Field of the Invention

The present invention relates to a recording apparatus used with a copying machine, a printer, a facsimile and the like, and more particularly, it relates to a recording apparatus having a plurality of sheet supply paths.

2. Related Background Art

Recently, recording apparatuses used with copying machines, printers, facsimiles and the like have been made compact and cheaper, and a high speed operation thereof has been realized. Further, it is desired that various kinds of recording media (referred to as "sheets" hereinafter) can be used in the recording apparatus. In addition, since a case where a single recording apparatus is commonly used by a plurality of users has been increased, it is also desired that there are provided a plurality of sheet supply paths communicated with a single recording portion to supply a large number of sheets.

Further, an amount of colored data handled by a computer has also been increased to increase a total amount of data to be handled by the recording apparatus. Accordingly, electric circuits for processing such large amount of data become large-scaled, and a part of the large-scaled electric circuits is provided on an extension substrate which will be attached to a main substrate upon transportation or by a user later.

An example of a conventional recording apparatus having a plurality of sheet supply paths will now be explained with reference to FIG. 5. In FIG. 5, an auto sheet feeder (ASF) (first supply path) 101 is disposed at an upper part of a main body 100 of a recording apparatus at a rear (left in FIG. 5) side thereof and is designed so that one of sheets S rested on a pressure plate 102 is supplied through a first sheet supply path (shown by the arrow b in FIG. 5) by a sheet supply roller 103 rotated in a direction shown by the arrow a in FIG. 5. The sheet S fed out by the sheet supply roller 103 is pinched between a convey roller 104 and a pinch roller 105 urged against the convey roller 104 and is conveyed to a recording position where an image is recorded on the sheet by a recording head 106. The sheet S on which the image was recorded is discharged toward a direction shown by the arrow c in FIG. 5 by a discharge roller 107 and a spur wheel roller 108 urged against the discharge roller 107.

A manual insertion sheet supply path (second supply path) 111 is disposed at a rear side of the main body 100 of the recording apparatus between a sheet guide 109 provided on a rear side of the auto sheet feeder 101 and a substantially horizontal sheet guide 110. The manual insertion sheet supply path 111 is joined to the first sheet supply path in front of the recording head 106. A sheet S inserted into the manual insertion sheet supply path 111 from a direction shown by the arrow d in FIG. 5 is pinched between the convey roller 104 and the pinch roller 105. Then, similar to the above case, an image is formed on the sheet S by the recording head 106 and the imaged sheet is discharged toward the direction shown by the arrow c in FIG. 5 by the discharge roller 107 and the spur wheel roller 108.

A manual insertion supply path (third sheet supply path) 113 comprised of a U-turn guide 112 is disposed around the convey roller 104 at the front side (left side in FIG. 5) of the main body 100 of the recording apparatus. A sheet S inserted into the manual insertion sheet supply path 113 from a direction shown by the arrow e in FIG. 5 is guided around the convey roller 104 by the U-turn guide 112 to be reversely rotated and then is pinched between the convey roller 104 and the pinch roller 105. Then, similar to the above case, an image is formed on the sheet S by the recording head 106 and the imaged sheet is discharged toward the direction shown by the arrow c in FIG. 5 by the discharge roller 107 and the spur wheel roller 108.

However, in the above-mentioned conventional technique, since there is a single automatic sheet supply means comprised of the auto sheet feeder 101, if another kind of sheet S are desired, the user must go to the main body 100 of the recording apparatus to remove the sheets S remaining in the auto sheet feeder 101 and to set another kind of sheet S in the auto sheet feeder 101. This worsens the operability. Further, the single automatic sheet supply means limits the number of sheets S to be handled and makes the common use of the recording apparatus by plural users difficult. Furthermore, in the above-mentioned conventional recording apparatus 100, since there is a dead space between the plurality of sheet supply paths and an electrical mounting portion (not shown) is arranged at an exclusive space for the electrical mounting portion within the main body 100 of the recording apparatus, the recording apparatus 100 itself is made bulky.

SUMMARY OF THE INVENTION

The present invention intends to eliminate the above-mentioned conventional drawbacks, and has an object to provide a recording apparatus having a plurality of automatic supply means, in which different kinds of sheets can selectively be supplied automatically or a large number of similar sheets can be supplied automatically and continuously, and in which an electrical mounting portion can be disposed between a plurality of sheet supply paths to effectively use a dead space in the recording apparatus. Thus, the recording apparatus is made compact and in which a shield member for the electrical mounting portion can also act as a sheet guide member, to thereby make the recording apparatus cheaper.

DETAILED DESCRIPTION OF THE PREFERRED EMBODIMENTS

Figure 1:
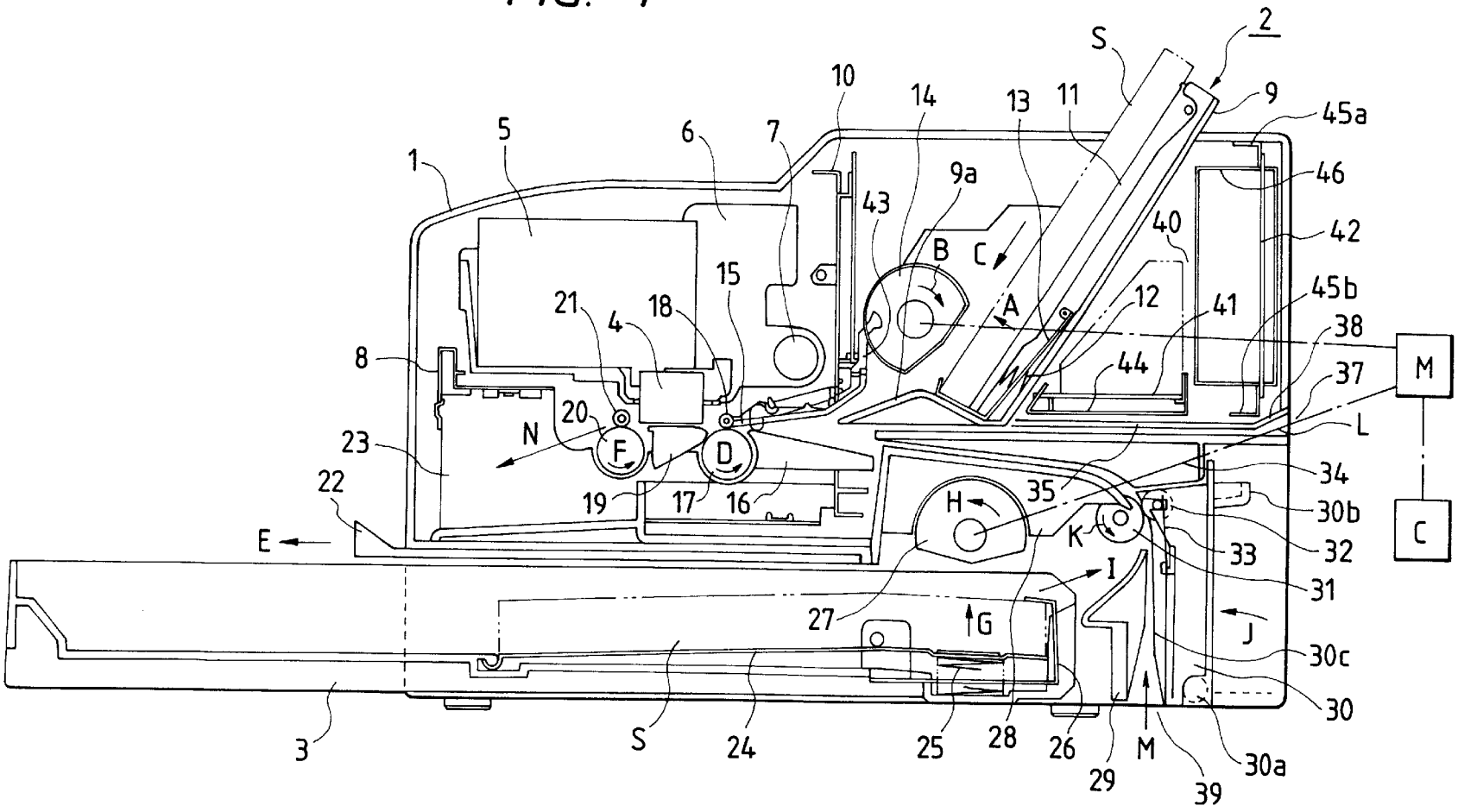
FIG. 1 is a sectional view of a recording apparatus according to a preferred embodiment of the present invention.
Figure 2:
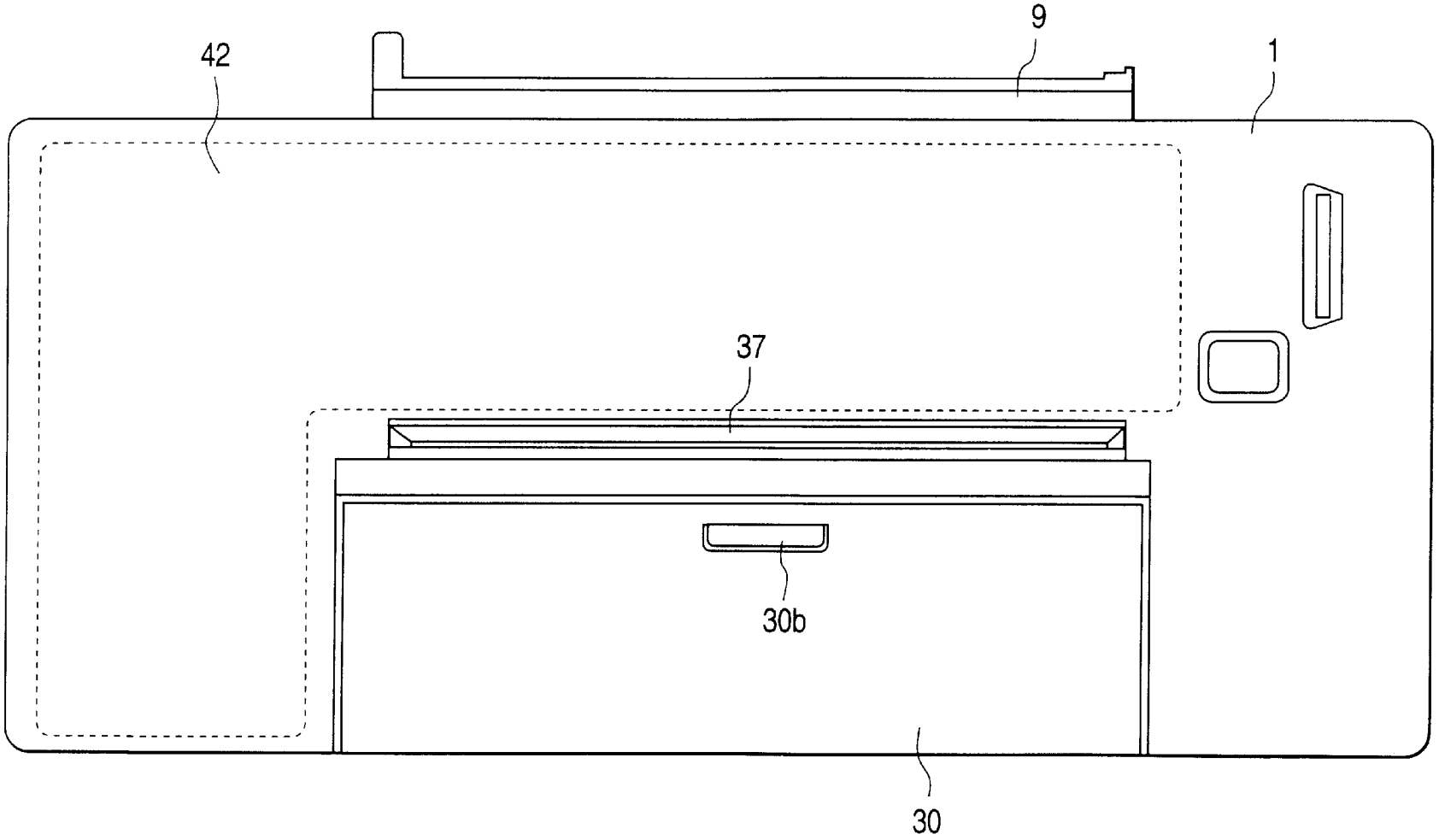
FIG. 2 is a rear view of the recording apparatus of FIG. 1.

A recording apparatus according to an embodiment of the present invention which is applied to a printer will now be fully explained with reference to the accompanying drawings. FIG. 1 is a sectional view of a recording apparatus according to a preferred embodiment of the present invention, and FIG. 2 is a rear view of the recording apparatus.

Figure 5:
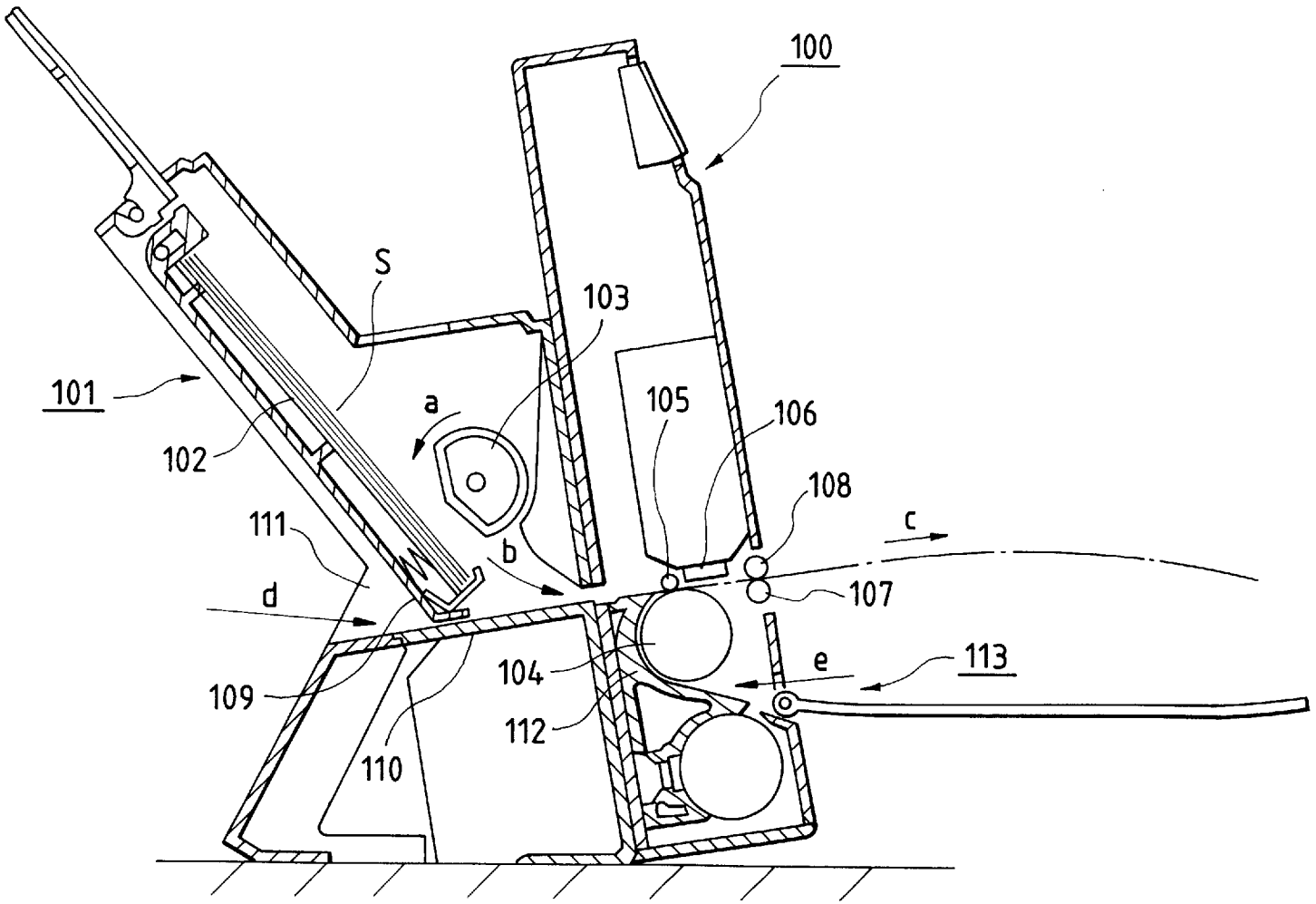
FIG. 5 is a sectional view showing an example of a conventional recording apparatus.

In FIG. 1, an auto sheet feeder (ASF) 2 including a supply roller (first automatic supply means) 14 for automatically supplying sheets S rested on a pressure plate (first sheet supporting means) 11 for obliquely supporting the sheets is disposed at an upper part of a main body 1 of a recording apparatus according to the present invention at a rear (right in FIG. 1) side thereof, and a sheet cassette (second sheet supporting means) 3 detachably (in a left-and-right direction) mounted on the main body 1 of the recording apparatus to support sheets S substantially horizontally is disposed at a front (left in FIG. 5) side of the main body 1 of the recording apparatus at a lower part thereof. The sheets S contained in the sheet cassette 3 are automatically supplied by a supply roller 27 and a convey roller 31 (second automatic supply means).

A recording head (recording means) 4 is disposed at a front upper part of the main body 1 of the recording apparatus. An ink tank 5 serves to supply ink to the recording head 4. The recording head 4 and the ink tank 5 are mounted on a carriage 6. The carriage 6 is shifted along a guide shaft 7 and a rail 8 so that a lower surface of the recording head 4 can be shifted in a direction (main scan direction) perpendicular to a sheet supplying direction. When the carriage 6 is driven in the main scan direction by a main scan motor and a belt (both are not shown), an image is recorded on the sheet by the recording head 4 in response to image information.

The recording means of this recording apparatus is of ink jet recording type in which the recording is effected by discharging the ink from the recording head 4. That is to say, the recording head includes fine liquid discharge openings (orifices), liquid passages, energy acting portions disposed in the respective liquid passages, and energy generating means for generating liquid droplet forming energy in the liquid on the energy acting portions. Regarding such energy generating means for generating the energy, there are a recording method using an electrical/mechanical converter such as a piezo-electric element, a recording method using energy generating means in which liquid is heated by illuminating electromagnetic wave such as laser onto the liquid and liquid droplet is discharged under the action of the heat, and a recording method using energy generating means in which liquid is heated by an electrical/thermal converter such as a heat generating element having a heat generating resistance body to discharge the liquid.

Among them, a recording head used in an ink jet recording method in which liquid is discharged by thermal energy permits the recording with high resolving power since liquid discharge openings (orifices) for forming and discharging recording liquid droplets can be arranged with high density. Further, the recording head using the electrical/thermal converters as energy generating means can easily be made compact, can fully utilize merits of IC techniques and micro-working techniques which have remarkably been progressed in the recent semi-conductor field and in which reliability has been improved, can be mounted with high density and can be made cheaper.

In the illustrated embodiment, while an example that the recording means is of ink jet recording type was explained, it is more preferable that the recording is effected by discharging ink from a discharge opening by growth and contraction of a bubble generated in the ink by utilizing film-boiling caused by thermal energy by energizing an electrical/thermal converter in response to a record signal. The representative structure thereof may be realized by using the fundamental principle disclosed in U.S. Pat. Nos. 4,723,129 and 4,740,796 .

Returning to FIG. 1, a base 9 supporting the entire auto sheet feeder 2 is secured to a chassis 10 of the main body 1 of the recording apparatus. The pressure plate 11 on which the sheets S made of paper or synthetic resin are supported and rested has one end pivotally connected to the base 9. The pressure plate 11 is biased toward a direction shown by the arrow A in FIG. 1 by a pressure plate spring 12. A separation pawl 13 has one end pivotally connected to the base 9 and the other end for engaging with a front end corner of the sheet stack S on the pressure plate 11 to regulate an uppermost sheet in the sheet stack by the weight of the separation pawl.

The supply roller 14 is formed from high friction material such as rubber and is rotatably supported by the chassis 10. The supply roller 14 is rotated in a direction B in FIG. 1 by a supply motor (not shown) and can abut against the uppermost sheet S in the sheet stack. Among the sheets fed out by the supply roller 14, only the uppermost sheet S is separated from the other sheets by the separation pawl 13 and the separated sheet is supplied toward a direction shown by the arrow C in FIG. 1. The sheet S is conveyed obliquely and downwardly through a first sheet supply path defined by a guide portion 9a of the base 9 and an upper guide 15 and then is introduced into a common convey path defined by the upper guide 15 and a guide member 16 disposed at a downstream side in a sheet supplying direction (referred to merely as "downstream side " hereinafter) to be brought to a nip between a sub-scan roller 17 disposed at a downstream side and a pinch roller 18 urged against the sub-scan roller 17.

The sub-scan roller 17 is rotatably supported by the chassis 10 and is rotatingly driven in a direction shown by the arrow D in FIG. 1 by a sub-scan motor (not shown). The pinch roller 18 is rotatably mounted on the upper guide 15 rotatably supported by the chassis 10 and is urged against the sub-scan roller 17 by means of a spring (not shown). The sheet S pinched between the sub-scan roller 17 and the pinch roller 18 is conveyed by a predetermined amount at a predetermined timing. Flatness of the sheet is maintained by supporting the rear surface of the sheet by a platen 19 disposed in a confronting relation to the recording head 4, and an image is recorded on the sheet by reciprocating the recording head 4 in the main scan direction.

The sheet S on which the image was recorded by the recording head 4 is pinched between a discharge roller 20 disposed at a downstream side and a spur wheel roller 21 urged against the discharge roller 20 and is discharged through a sheet discharge path onto a discharge tray 22 extended or extracted in a direction shown by the arrow E in FIG. 1 at the front side of the main body 1 of the recording apparatus. The discharge roller 20 is rotatably supported by the chassis 10 and is rotated by the sub-scan motor in a direction shown by the arrow F in FIG. 1. The spur wheel roller 21 is rotatably supported by the chassis 10 via a holding member (not shown) and is urged against the discharge roller 20 by an urging spring. The sub-scan roller 17 and the discharge roller 20 are rotated in synchronous with each other. A conveying amount of the discharge roller 20 is selected to be slightly greater than a conveying amount of the sub-scan roller 17 so that any looseness is not generated in the sheet S between the sub-scan roller 17 and the discharge roller 20.

A sheet sensor 43 rockable with respect to the chassis 10 serves to detect the sheet S entering into the nip between the sub-scan roller 17 and the pinch roller 18.

The discharge tray 22 provided in a discharge portion 23 is slidably disposed at the front lower part of the main body 1 of the recording apparatus so that, in use, the tray is extracted toward the direction E (FIG. 1) and, when the tray is not used, it is retracted toward a direction opposite to the direction E to be housed within the main body 1 of the recording apparatus.

The sheet cassette (second sheet supporting means) 3 is detachably mounted on the main body 1 of the recording apparatus so that the cassette can be mounted to and dismounted from the main body 1 along a sheet supplying direction from the cassette 3 or an opposite direction (i.e., left-and-right direction in FIG. 1). An intermediate plate 24 having one end pivotally connected to the sheet cassette 3 is disposed within the sheet cassette and a plurality of sheets S are stacked on the intermediate plate 24. The sheet stack S on the intermediate plate 24 is biased toward a direction shown by the arrow G in FIG. 1 by an intermediate plate spring 25 disposed below the intermediate plate 24. A separation pawl 26 is disposed at a rear (right in FIG. 1) end of the sheet cassette 3. The separation pawl 26 has one end pivotally connected to the sheet cassette 3 and the other end for abutting against an end corner of the sheet stack rested on the intermediate plate 24 to regulate an uppermost sheet in the sheet stack by the weight of the separation pawl itself.

A supply roller 27 made of high friction material such as rubber is rotatably supported by a guide member 28 secured to the main body 1 of the recording apparatus and is rotated by a supply motor (not shown) in a direction shown by the arrow H in FIG. 1. When the supply roller 27 abuts against the sheet stack to fed out the sheets, only the uppermost sheet S is separated from the other sheets and is supplied. The sheet S supplied by the supply roller 27 is introduced (in a direction shown by the arrow I in FIG. 1) into a second sheet supply path defined between the guide member 28 and a guide member 29 to be reversed or turned over and then is introduced into the common convey path defined between the guide member 16 and the upper guide 15.

A jam treatment member 30 is rotatably supported by the main body 1 of the recording apparatus via a pivot shaft 30*a* and is always biased toward a direction shown by the arrow J in FIG. 1 by a spring. By pulling a grip 30*b* in a direction opposite to the direction J, the jam treatment member 30 is rotated around the pivot shaft 30*a* to be opened with respect to the main body 1 of the recording apparatus, so that the second sheet supply path and a fourth sheet supply path (described later) are exposed to permit the sheet jam treatment.

A convey roller 31 is rotatably supported by the guide member 28 and is rotated by a convey motor in a direction shown by the arrow K in FIG. 1. An urging roller 32 is rotatably supported by the jam treatment member 30. When the jam treatment member 30 is closed, the urging roller 32 is urged against the convey roller 31 by a biasing force of a spring 33. A guide member 34 is disposed above the guide member 28. The sheet S separated and supplied from the sheet cassette 3 enters into a nip between the convey roller 31 and the urging roller 32 while being guided by the guide member 29 and a sheet guide surface 30*c* of the jam treatment member 30. Then, the sheet is pinched between the convey roller 31 and the urging roller 32 to be conveyed.

Then, the sheet is reversed (U-turn) between the guide members 28 and 34 and then is introduced into the first sheet supply path while being guided by the guide member 16 to reach the nip between the sub-scan roller 17 and the pinch roller 18. Thereafter, similar to the above, an image is recorded on the sheet by the downstream recording head 14 and the imaged sheet is discharged.

At the rear side of the main body 1 of the recording apparatus, below the auto sheet feeder 2 and above the guide member 34, there is provided a manual insertion supply path (third sheet supply path) 37 defined between the guide member 34 and a guide member 35. A sheet manually inserted into the manual insertion supply path 37 can be introduced into the common convey path defined between the guide member 16 and the upper guide 15. A tapered manual insertion guide member 38 for facilitating the insertion of the sheet S is provided at an entrance of the manual insertion supply path 37.

The manual insertion supply path (third sheet supply path) 37 is disposed between the first sheet supply path constituted by the guide portion 9*a* of the base 9, upper guide 15 and guide member 16 and the second sheet supply path constituted by the guide members 28, 34 and 16 and is joined to the first and second sheet supply paths at an upstream side of the recording head 14 in the sheet supplying direction. Accordingly, the sheet S inserted into the manual insertion supply path 37 from a direction shown by the arrow L in FIG. 1 is pinched between the sub-scan roller 17 and the pinch roller 18 to be conveyed, and, similar to the above, an image is recorded on the sheet by the recording head 14 and the imaged sheet is discharged.

On the other hand, at a rear lower part of the main body 1 of the recording apparatus, between the first sheet supply path and the second sheet supply path, there is provided a receiving opening 39 for receiving a sheet S supplied from other sheet cassettes or sheet decks. The sheet S introduced into the receiving opening 39 from a direction shown by the arrow M in FIG. 1 passes through the fourth sheet supply path defined between the guide member 29 and the sheet guide surface 30*c* of the jam treatment member 30 and enters into the second sheet supply path on the way thereof to be pinched between the convey roller 31 and the urging roller 32. Then, the sheet passes through the second sheet supply path and enters into the first sheet supply path to reach the nip between the sub-scan roller 17 and the pinch roller 18. Then, similar to the above, an image is recorded on the sheet by the downstream recording head 14 and the imaged sheet is discharged.

An electrical mounting portion 40 including electric circuits for controlling an operation of the recording apparatus is disposed within the main body 1 of the recording apparatus at a rear upper part thereof. The electrical mounting portion 40 is divided into a power source substrate 41 and an extension substrate 42. The power source substrate 41 is disposed below the auto sheet feeder 2 and is supported by a substantially horizontal support frame 44 disposed above the manual insertion supply path 37.

The extension substrate 42 is uprightly supported by a support fitting 45*a* attached to an inner surface of an outer cover of the main body 1 of the recording apparatus below the auto sheet feeder 2 and a support fitting 45*b* disposed above the manual insertion supply path 37 and below the auto sheet feeder 2 (refer to FIG. 2). A shield member 46 serves to shield the extension substrate 42.

Next, the operation of the recording apparatus having the above-mentioned construction will be fully explained.

First of all, sheets S are stacked on the pressure plate 11 of the auto sheet feeder 2 at the front side of the main body 1 of the recording apparatus. Then, sheets S are stacked on the intermediate plate 24 of the sheet cassette 3 dismounted from the ma in body 1 of the recording apparatus and then the sheet cassette 3 is mounted to the main body 1 of the recording apparatus from the front side thereof. Then, the discharge tray 22 is extracted toward the direction E (FIG. 1).

In a case where the sheet S is supplied from the auto sheet feeder 2, when a record command is received from a computer (not shown) and the like, a control circuit of the electrical mounting portion 40 causes the supply motor (not shown) to rotate to thereby rotate the supply roller 14 i n the direction B (FIG. 1). As a result, only the uppermost sheet S in the sheet stack rested on the pressure plate 11 is separated by the separation pawl 13, and the separated sheet is supplied toward the direction C (FIG. 1).

An advancing direction of the sheet S supplied by the supply roller 14 is regulated by the upper guide 15, and the sheet is passed through the first sheet supply path defined between the upper guide 15 and the guide portion 9*a* of the base 9; meanwhile, the sheet sensor 43 is rocked by the sheet. As a result, the tip end of the sheet is detected. When the sheet is further conveyed by the supply roller 14 by a predetermined amount, the tip end of the sheet abuts against the nip between the sub-scan roller 17 and the pinch roller 18 (which are now stopped).

Consequently, a loop is formed in the sheet S fed out by the supply roller 14 to align the tip end of the sheet with the nip between the sub-scan roller 17 and the pinch roller 18 to thereby correct the skew-feed of the sheet. At this point, the supply roller 14 is stopped temporarily.

Thereafter, the sub-scan roller 17 is rotatingly driven in synchronous with the supply roller 14 to convey the sheet to the recording area where the recording head 14 is positioned. The carriage 6 is reciprocated in the main scan direction above the sheet S a lower surface of which is supported by the platen 19 to thereby effect the recording. By repeating the sheet feed of the sub-scan roller 17 and the reciprocal movement of the carriage 6 alternately, the recording operation is repeated. While the sheet is being conveyed by the discharge roller 20 and the spur wheel roller 21, the recording of the predetermined image effected by the recording head 14 is completed.

The sheet S on which the image was recorded is discharged by the discharge roller 20 and the spur wheel roller 21 in a direction shown by the arrow N in FIG. 1 and is rested on the discharge tray 22 (previously extracted in the direction E) with the imaged surface facing upwardly.

In a case where the sheet S is supplied from the sheet cassette 3, the supply roller 27 is rotated by the supply motor in the direction H (FIG. 1), so that only the uppermost sheet S in the sheet stack rested on the intermediate plate 24 is separated from the other sheets, and the separated sheet is supplied in the direction I (FIG. 1). Then, the sheet S is guided by the guide member 29 and the sheet guide surface 30*c* of the jam treatment member 30 to reach the nip between the convey roller 31 and the urging roller 32. Then, the sheet is pinched between the convey roller 31 and the urging roller 32 to be further conveyed. The sheet is directed to the guide members 28, 34, 16 and the upper guide 15. When the sheet sensor 43 is rocked by the sheet, the tip end of the sheet is detected. When the sheet is further conveyed by the convey roller 31 and the urging roller 32 by a predetermined amount, the tip end of the sheet abuts against the nip between the sub-scan roller 17 and the pinch roller 18 (which are now stopped).

Consequently, a loop is formed in the sheet S fed out by the convey roller 31 and the urging roller 32 to align the tip end of the sheet with the nip between the sub-scan roller 17 and the pinch roller 18 to thereby correct the skew-feed o f the sheet. At this point, the convey roller 31 is stopped temporarily. Thereafter, the sub-scan roller 17 is rotatingly driven in synchronous with the convey roller 31 to convey the sheet to the recording area where the recording head 14 is positioned. Similar to the above, the image is recorded on the sheet and the imaged sheet is discharged onto the discharge tray 22.

Now, control for correcting the skew-feed of the sheet (by forming the loop in the sheet by abutting the sheet S against the nip between the sub-scan roller 17 and the pinch roller 18) and for adjusting the recording timing will be explained.

The sheet S supplied from the sheet cassette 3 is reversed by the guide member 29 and the sheet guide surface 30*c*. Thus, convey resistance acting on the sheet S supplied from the sheet cassette 3 becomes greater than convey resistance acting on the sheet S supplied from the auto sheet feeder 2. Due to such convey resistance, the sheet being conveyed may often be slipped to decrease the conveying amount of the sheet achieved by the convey roller 31 and the urging roller 32. This is noticeable particularly when the conveying force of the convey roller 31 is weak.

In the illustrated embodiment, when the tip end of the sheet S is detected by the sheet sensor 43, the sheet is further conveyed by the predetermined amount to abut the tip end of the sheet against the nip between the sub-scan roller 17 and the pinch roller 18 to thereby form the loop in the sheet. However, if the conveying amount of the sheet is inadequate, the loop will not be formed sufficient to correct the skew-feed of the sheet.

To eliminate such an inconvenience, the supply roller 14 and the convey roller 31 are controlled as follows. That is to say, in order to properly set the amount of the loop formed in the sheet S by abutting the sheet fed by the supply roller 14 against the nip between the sub-scan roller 17 and the pinch roller 18 and the amount of the loop formed in the sheet S fed by the convey roller 31 and the urging roller 32, the respective conveying amounts of the sheets after the tip end of the sheet S leaves the sheet sensor 43 are set by appropriately controlling a pulse motor M by means of a control means C. Incidentally, in this example, the pulse motor M is commonly used for driving both the supply roller 14 and the convey roller 31 and is appropriately switched by a clutch.

Figure 4:
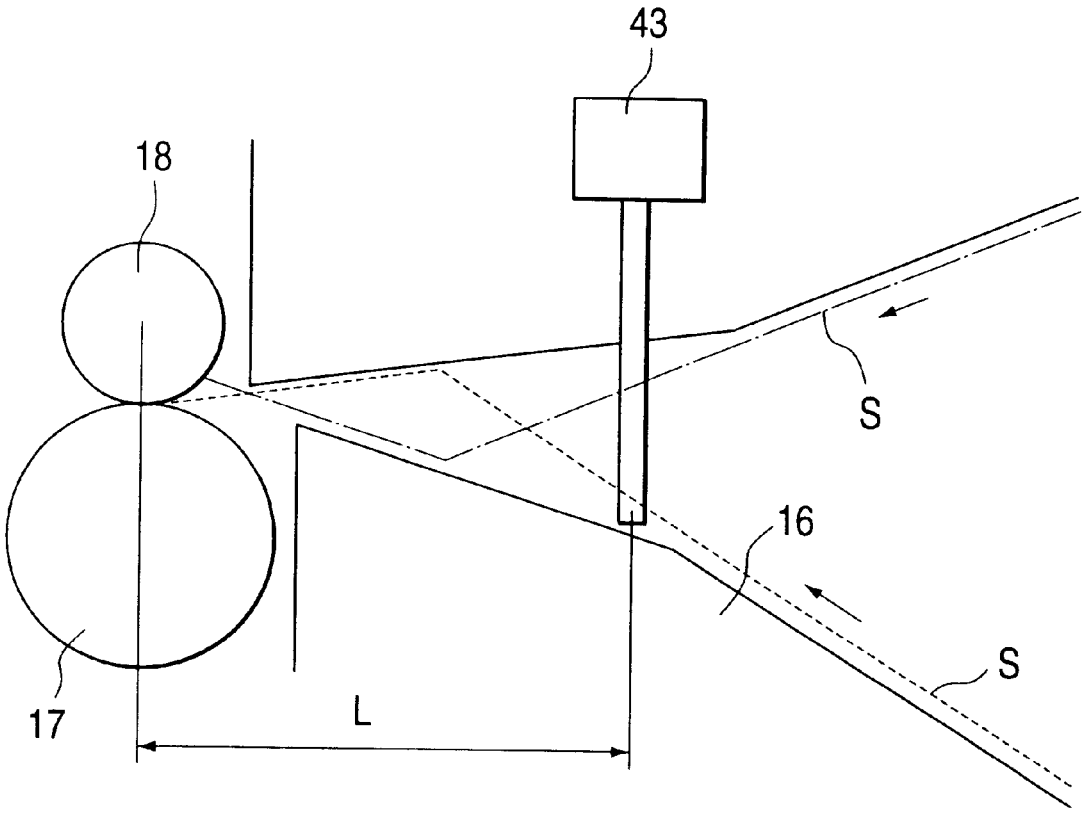
FIG. 4 is an enlarged view showing a main part of the recording apparatus of FIG. 1.

In the illustrated embodiment, as shown in FIG. 4, regarding the sheet S supplied from the sheet cassette 3, the conveying amount of the sheet effected by the convey roller 31 after the tip end of the sheet leaves the sheet sensor 43 is selected to become greater than a distance L from the sheet sensor 43 to the nip between the sub-scan roller 17 and the pinch roller 18 by about 5 mm to form the loop in the sheet. On the other hand, regarding the sheet S supplied from the auto sheet feeder 2, the conveying amount of the sheet effected by the supply roller 14 after the tip end of the sheet leaves the sheet sensor 43 is selected to become greater than the distance L by about 3 mm to form the loop in the sheet.

By increasing the conveying amount of the sheet supplied from the sheet cassette 3 more than that of the sheet supplied from the auto sheet feeder, even if the slip is caused in the sheet, substantially the same amount of loop as that of the sheet supplied from the auto sheet feeder can be formed in the sheet to thereby achieve the stable sheet conveyance.

In a case where the sheet S is supplied from the manual insertion supply path 37, when the sheet S is inserted through the manual insertion guide member 38, the sheet is advanced in the direction L (FIG. 1) through the third sheet supply path defined by the guide members 34, 35; meanwhile, the sheet sensor 43 is rocked by the sheet to detect the tip end of the sheet S. Then, the sheet is urged against the nip between the sub-scan roller 17 and the pinch roller 18 to correct the skew-feed of the sheet. After a predetermined time period is elapsed, the sub-scan roller 17 is rotated in the direction D (FIG. 1). As a result, similar to the above cases, an image is formed on the sheet by the recording head 14 and the imaged sheet is discharged onto the discharge tray 22.

Next, a case where the sheet is supplied from other sheet cassette or sheet deck through the receiving opening 39 will be explained. The sheet is conveyed through the fourth sheet supply path defined between the guide member 29 and the sheet guide surface 30*c* of the jam treatment member 30 to reach the nip between the convey roller 31 and the urging roller 32. After the sheet is pinched between the convey roller 31 and the urging roller 32, the sheet is conveyed in the same manner as the sheet supplied from the sheet cassette 3. Thereafter, similar to the above cases, an image is formed on the sheet by the recording head 14 and the imaged sheet is discharged onto the discharge tray 22.

As mentioned above, in the illustrated embodiment, different kinds of sheets or a plurality of sheets having different sizes can selectively be supplied to the recording means to form the image on the sheet. Thus, for example, normal sheets which are frequently used or sheets having relatively low rigidity may be stacked in the sheet cassette 3, sheets having relatively high rigidity or sheets which are not used frequently may be stacked in the auto sheet feeder 2, and a sheet having great rigidity and not desired to be bent may be supplied by using the manual insertion guide member 38.

Further, the same kind of sheets having the same size may be stacked in both the auto sheet feeder 2 and the sheet cassette 3 so that a large amount of sheets can be supplied by controlling in such a manner that, when the sheets stacked in one of the auto sheet feeder 2 and the sheet cassette 3 are used up, the supplying of the sheets stacked in the other is started.

Figure 3:
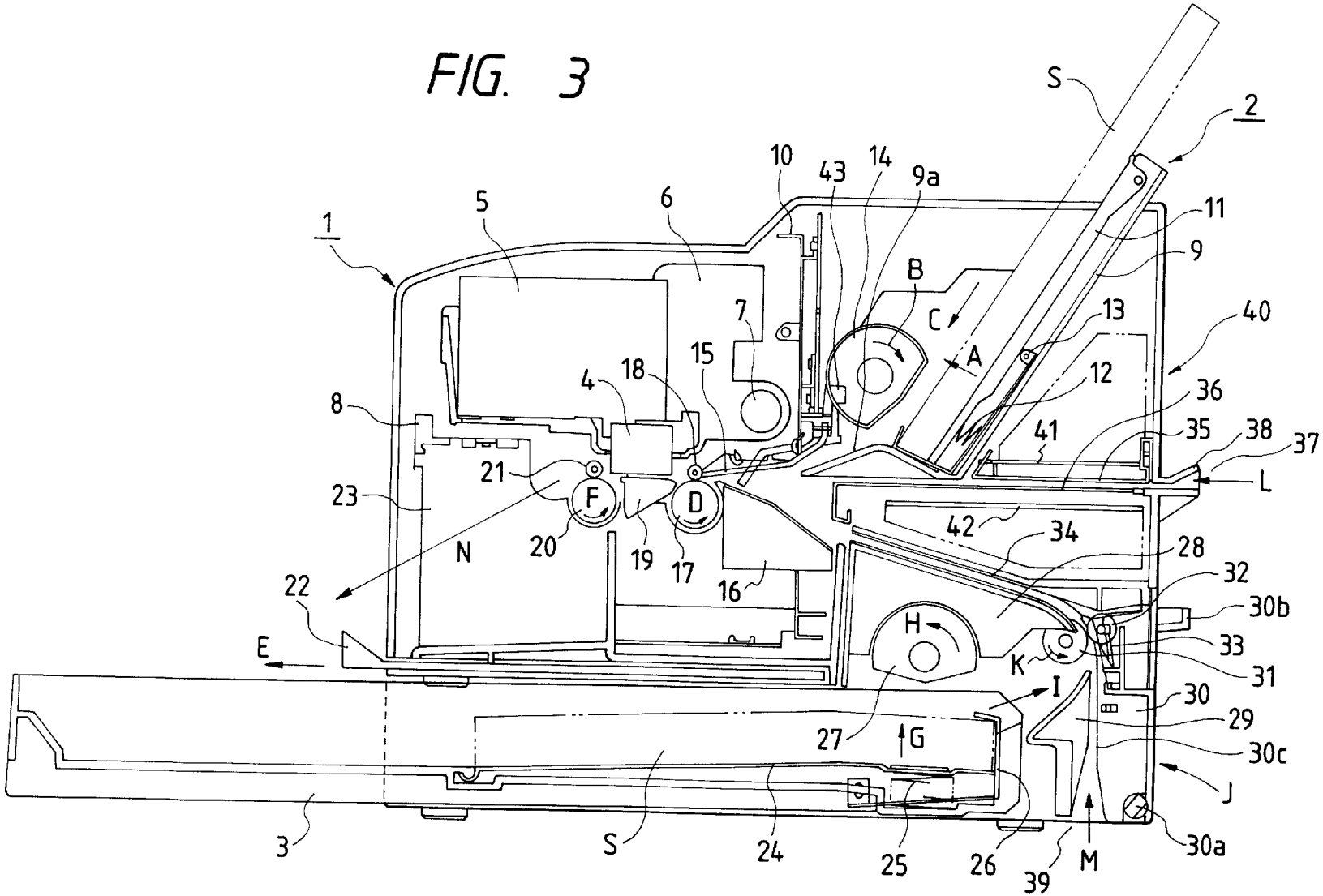
FIG. 3 is a sectional view of a recording apparatus according to another embodiment of the present invention.

Next, a recording apparatus according to another embodiment of the present invention in which arrangement of substrates are altered will be explained with reference to FIG. 3. Incidentally, the same elements as those in the aforementioned embodiment are designated by the same reference numerals and explanation thereof will be omitted.

In the aforementioned embodiment, as shown in FIGS. 1 and 2, the power source substrate 41 and the extension substrate 42 which constitute the electrical mounting portion 40 were disposed side by side above the manual insertion supply path 37 at the rear side of the auto sheet feeder 2. To the contrary, in this embodiment, as shown in FIG. 3, at a rear part of the main body 1 of the recording apparatus, below the auto sheet feeder 2 and above the guide plate 34, there is provided a manual insertion supply path (third sheet supply path) 37 defined between the guide member 35 and a guide member 36. As is in the aforementioned embodiment, the manual insertion supply path 37 is disposed between the first sheet supply path constituted by the guide portion 9*a* of the base 9 and the upper guide 15 and the second sheet supply path constituted by the guide members 28, 34 and is joined to the first and second sheet supply paths at the upstream side of the recording head 14 in the sheet supplying direction.

Accordingly, in the case where the sheet is supplied from the manual insertion supply path 37, when the sheet is inserted through the manual insertion guide member 38, the sheet is passed through the third sheet supply path defined between the guide members 35 and 36 in the direction L (FIG. 3); meanwhile, the sheet sensor 43 is rocked by the sheet to detect the tip end of the sheet S. Then, the sheet is urged against the nip between the sub-scan roller 17 and the pinch roller 18 which are now stopped to thereby correct the skew-feed of the sheet. After the predetermined time period is elapsed, the sub-scan roller 17 is rotated in the direction D (FIG. 3). Consequently, the image is recorded on the sheet by the recording head 14 and the imaged sheet is discharged onto the discharge tray 22.

In the above-mentioned arrangement, a power source substrate 41 is disposed below the auto sheet feeder 2 and above the manual insertion supply path 37 and an extension substrate 42 is disposed below the manual insertion supply path 37 and above the guide member 34.

Various electrical parts or elements are mounted on the substrates 41, 42 to be contained within spaces above the substrates to thereby effectively utilize the dead space in the main body 1 of the recording apparatus to make the recording apparatus compact. Further, since a dimension of the main body 1 of the recording apparatus in the front-and-rear direction (left-and-right direction) can be reduced to decrease the length of the manual insertion supply path 37, a relatively short sheet S can be inserted.

The power source substrate 41 is supported within the main body 1 of the recording apparatus by the guide member 35 defining the upper wall of the manual insertion supply path 37, and the extension substrate 42 is supported within the main body 1 of the recording apparatus by the guide member 36 defining the lower wall of the manual insertion supply path 37. In this case, the guide member 35 also acts as a shield member for the power source substrate 41 and the guide member 36 also acts as a shield member for the extension substrate 42. Thus, the number of parts can be decreased to reduce the material cost, the number of assembling steps can also be decreased, and the entire recording apparatus 1 can be made compact.

The (ink jet) recording apparatus in the abovementioned embodiments may be used as an image output terminal of an information processing equipment such as a computer, as a copying machine with combination of a reader, or a facsimile having a transmission function.

In the above-mentioned embodiments, while an example that the ink jet recording head is used as the recording means was explained, the present invention is not limited to the ink jet recording head, but, a heat-transfer recording head, a heat-sensitive recording head, an impact recording head such as a wire dot recording head or other recording heads may be used. Further, the present invention is not limited to a serial recording system, but, a so-called line recording system may be used.

What is claimed is:

1. A recording apparatus comprising:

a recording means for recording, in response to image information, an image on a sheet conveyed through a common convey path;

a first sheet supporting means disposed at an upper part of a main body of the recording apparatus for obliquely supporting stacked sheets;

a first automatic supply means for automatically supplying the sheet supported by said first sheet supporting means;

a second sheet supporting means disposed at a lower part of the main body of the recording apparatus to support stacked sheets horizontally;

second automatic supply means for automatically supplying the sheet supported by said second sheet supporting means;

a first sheet supply path for conveying the sheet supplied from said first automatic supply means sloped downwardly toward said common convey path;

a second sheet supply path for reversing a surface of the sheet supplied from said second automatic supply means and conveying toward said common convey path; and a third sheet supply path through which a sheet can be manually supplied to said common convey path, wherein said third sheet supply path is disposed between said first sheet supply path and said second sheet supply path, and said third sheet supply path is disposed on a plane with said common convey path.

2. A recording apparatus according to claim 1, wherein said second sheet supporting means is a sheet cassette detachably mounted on the main body of the recording apparatus.

3. A recording apparatus according to claim 1, wherein said recording means includes an ink jet recording head for effecting the recording by discharging ink in response to a signal.

4. A recording apparatus comprising:

a first automatic supply means disposed at a rear upper part of a main body of the recording apparatus for automatically supplying a sheet;

a second automatic supply means disposed at a front lower part of the main body of the recording apparatus for automatically supplying a sheet;

a recording means for recording an image on the sheet conveyed through a common convey path in response to image information;

a first sheet supply path for directing the sheet supplied from said first automatic supply means to said recording means;

a second sheet supply path for directing the sheet supplied from said second automatic supply means to said recording means;

a sheet discharge path for discharging the sheet on which the image was recorded by said recording means toward a front side of the main body of the recording apparatus;

wherein said first and second sheet supply paths are joined to each other at an upstream side of said recording means in a sheet supplying direction, and the sheets supplied through said first and second sheet supply paths are image- recorded by the recording means and are discharged at the front side of the main body of the recording apparatus through said sheet discharge path; and a third sheet supply path disposed between said first sheet supply path and said second sheet supply path and joined to them from a rear side of the main body of the recording apparatus at the upstream side of said recording means in the sheet supplying direction, wherein said third sheet supply path is disposed on a plane with said common convey path.

5. A recording apparatus according to claim 4, further comprising a fourth sheet supply path disposed between said first sheet supply path and second sheet supply path and joined to them from a lower rear side of the main body of the recording apparatus upstream of said recording means in the sheet supplying direction.

6. A recording apparatus according to claim 5, wherein said fourth sheet supply path joins said second sheet supply path upstream of said recording means.

7. A recording apparatus according to claim 4, wherein said second automatic supply means is a sheet cassette detachably mounted on the main body of the recording apparatus, and a mounting/dismounting direction of said sheet cassette is aligned with a supplying direction of the sheet supplied from said sheet cassette or a direction opposite to the supplying direction of the sheet.

8. A recording apparatus according to claim 4, wherein an electrical mounting portion is disposed between two different sheet supply paths among a plurality of said sheet supply paths.

9. A recording apparatus according to claim 8, wherein said electrical mounting portion includes a power source substrate.

10. A recording apparatus according to claim 8, wherein said electrical mounting portion includes an extension substrate.

11. A recording apparatus according to claim 8, wherein a shield member for said electrical mounting portion also acts as a sheet guide member for said sheet supply paths.

12. A recording apparatus according to claim 11, wherein said recording means includes an ink jet recording head for effecting the recording by discharging ink in response to a signal.

* * * * *

UNITED STATES PATENT AND TRADEMARK OFFICE

CERTIFICATE OF CORRECTION

PATENT NO. : 6,152,561
DATED : November 28, 2000
INVENTOR(S) : Hiroshi Watanabe

It is certified that error appears in the above-identified patent and that said Letters Patent is hereby corrected as shown below:

Column 5,
Line 26, "fed" should read -- feed --.

Column 7,
Line 3, "i n" should read -- in --.
Line 62, "o f" should read -- of --.

Column 9,
Line 6, "cassette" should read -- cassettes --, and "deck" should read -- decks --.

Column 11,
Line 27, "conveyed through a common convey path" should be deleted.
Line 44, "image-recorded by the recording means and " should be deleted.

Column 12,
Line 1, "are" should be deleted.
Line 38, "paths." should read -- path. --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*